US006105665A

United States Patent [19]

Ghiani

[11] Patent Number: 6,105,665

[45] Date of Patent: Aug. 22, 2000

[54] HEAT EXCHANGER AND PROCESS OF MANUFACTURING TUBES FOR SAME

[75] Inventor: Franco Ghiani, Bietigheim-Bissingen, Germany

[73] Assignee: Behr GmbH & Co., Stuttgart, Germany

[21] Appl. No.: 09/092,949

[22] Filed: Jun. 8, 1998

[30] Foreign Application Priority Data

Jun. 6, 1997 [DE] Germany ..... 197 23 878

[51] Int. Cl.[7] ..... F28F 1/02

[52] U.S. Cl. ..... 165/172; 165/153; 165/DIG. 507; 165/DIG. 509; 165/DIG. 506

[58] Field of Search ..... 165/152, 153, 165/172

[56] References Cited

U.S. PATENT DOCUMENTS

| | | | |
|---|---|---|---|
| 4,592,414 | 6/1986 | Beasley | 165/76 |
| 4,745,967 | 5/1988 | Kern | 165/150 |
| 4,775,006 | 10/1988 | Hesse | 165/150 |
| 5,538,077 | 7/1996 | So et al. | 165/109.1 |

FOREIGN PATENT DOCUMENTS

| | | | |
|---|---|---|---|
| 0 106 479 | 4/1984 | European Pat. Off. . | |
| 580 039 | 6/1924 | France . | |
| 25 21 271 | 11/1975 | Germany . | |
| 36 22 953 | 1/1988 | Germany . | |
| 37 01 865 | 8/1988 | Germany . | |
| 90 02 440 | 6/1990 | Germany . | |
| 195 43 986 | 5/1997 | Germany . | |
| 850871 | 10/1960 | United Kingdom | 165/153 |

*Primary Examiner*—Allen Flanigan

*Attorney, Agent, or Firm*—Evenson, McKeown, Edwards & Lenahan, P.L.L.C.

[57] ABSTRACT

Heat exchangers are known which are constructed of flat tubes which are formed in that the bent-open tube ends of the flat tubes are joined with contact surfaces, openings in the contact surfaces contributing to the formation of coolant tanks. The closure of the bent-open areas is achieved by inserting special covers. The bent-open areas of the tube ends are constructed to be larger and to use the wall parts projecting beyond the contact surface for forming a tight closure. This can take place by a folding, an overlapping or an obtuse placing against one another of the wall parts which are folded to the inside. The flat-tube heat exchangers may be used, for example, as transmission oil coolers.

7 Claims, 5 Drawing Sheets

HEAT EXCHANGER AND PROCESS OF MANUFACTURING TUBES FOR SAME

BACKGROUND AND SUMMARY OF THE INVENTION

This application claims the priority of German patent application 197 23 878.5, filed Jun. 6, 1997, the disclosure of which is expressly incorporated by reference herein.

The invention relates to a heat exchanger comprising several flat tubes whose open ends are widened for forming sections of the coolant tanks and by means of contact surfaces having passage openings are placed directly on adjacent flat tubes and are provided with a tight closure on the open side.

Heat exchangers of this type of construction are known from German Patent Document DE-A 36 22 953 or from German Patent Document DE-A 37 01 865. In these known constructions, the tube ends are bent open to form approximately rectangular tanks and their larger lateral surfaces are provided with passage openings so that, when the flat tubes are placed against one another with their widened end sections, they leave a space between one another for receiving fin lamellae. These constructions avoid the otherwise required insertion of intermediate rings between the tube ends (European Patent Application EP-A 01 06 479) and therefore permit a relatively simple construction of the initially mentioned heat exchangers. In the known constructions, the open sides of the bent-open end tanks of the flat tubes were in each case closed by inserted covers so that in this manner, after the adjoining of the flat tubes, a continuous coolant tank is formed and, on the other hand, it is ensured that the bent-open tanks at the end of the flat tubes are dimensionally stable and do not lose the parallelism of the contact surfaces with the passage openings.

It is an object of the invention to further simplify the construction of heat exchangers of the above-mentioned type. According to the invention, this and other objects have been achieved in that, in the case of a heat exchanger of the initially mentioned type, the tight closure of the open tube ends is formed by wall parts of the flat tube ends which project beyond the contact surfaces and which are folded back to the inside, are placed against one another and are connected with one another.

This further development is based on the recognition that the additional arrangement of covers for closing off the bent-open tube ends can be eliminated if the bent-open area is constructed to be much larger than previously and the wall parts which project beyond the area of the contact surfaces with the passage openings are then used for forming the closure. This consideration departs from the previous opinion that a bending-open of flat tubes, because of the connected danger of a tearing of the tubes as the result of the expansion of the material, be constructed as short as possible or just as long as required. This therefore leads to the advantage that cover parts, which must be manufactured separately, must no longer be provided as the closure of the bent-open areas. The invention also eliminates the existing fear that the dimensional accuracy of the contact surfaces later to be placed against adjacent flat tubes, particularly their parallel alignment, may be disadvantageously influenced by the deformation of the wall parts adjoining the contact surfaces. It was found that the tight closing can be carried out by the corresponding wall parts of the longer bent-open area without any disadvantageous effect on the dimensions of the areas later to be placed against one another to form the coolant tank.

In a further development of the invention, the wall parts projecting beyond the contact surfaces may have a length which corresponds to at least half the width of the sections of the coolant tanks, optionally plus the dimension required for an overlapping or fold formation. As will be explained below, this further development makes it possible to produce the heat exchangers according to the invention in different fashions. Specifically, the projecting wall parts may be buckled toward the inside by approximately 90° and obtusely placed against one another and connected with one another, particularly welded to one another. However, it is also possible to construct the wall parts still longer, to let them overlap after the buckling and to connect them in this form. In both cases, the folds of the exterior wall formed on the narrow lateral surfaces of the bent-open end tanks of the flat tubes can be folded over and into the surface of the assigned side of the widened tank-shaped bent-open area.

Naturally, it is also possible to fold the projecting wall parts toward the inside, to place them flatly against one another approximately in the center plane of the flat tubes and then to shape them into a tight fold, which is known per se in the case of other developments of heat exchangers (European Patent Document EP 04 44 595 B1).

The invention also relates to a process for manufacturing the flat tubes for the heat exchanger according to the invention and provides in a first embodiment that, for manufacturing a flat tube, as outlined in the claim, the wall parts projecting over the contact surfaces, while buckling out the exterior walls of the widened area which extend transversely to them, are placed against one another, are optionally folded over to form a fold and are then connected. As a further development of this inventive idea, it was found to be very expedient that the wall parts, which before being placed against one another and folded, were buckled to the inside, are, in addition, buckled along a straight line extending in parallel to the end edge such that the end sections will again extend to the outside. As a further development of the invention, the parts, which point to the outside from the bend, are then placed flatly against one another and folded over to form the fold.

For producing another type of a tight closure, however, according to the invention, the wall sections can also first be bent by 90° and can then be placed obtusely against one another with their free edges and welded together, in which case, as explained above, the exterior wall parts which extend transversely to them are buckled to the outside and can then be folded into the surface of the widening.

Finally, it is also possible to buckle the wall parts by approximately 90° and to place them with their ends in an overlapping manner on one another. Also in this case, the exterior wall parts, which extend transversely to them, are buckled toward the outside and folded into the surface of the tank-shaped widening.

Other objects, advantages and novel features of the present invention will become apparent from the following detailed description of the invention when considered in conjunction with the accompanying drawings.

DETAILED DESCRIPTION OF THE DRAWINGS

Figure 1:
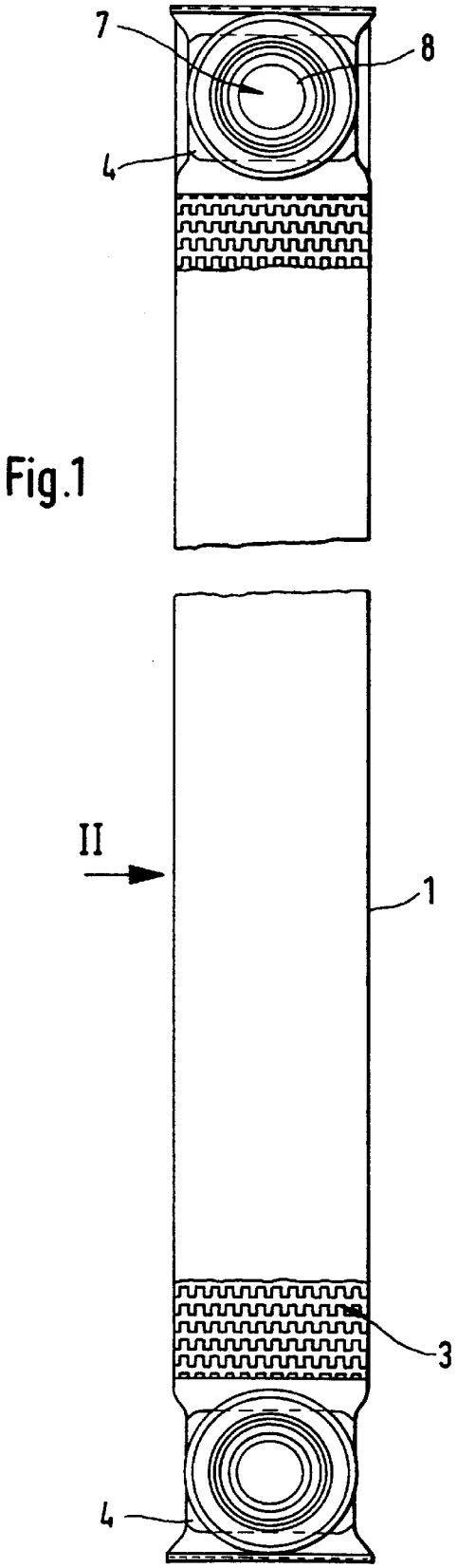
FIG. 1 is a schematic end view of a heat exchanger according to a preferred embodiment of the present invention in the direction of the plane I—I of FIG. 2.
Figure 2:
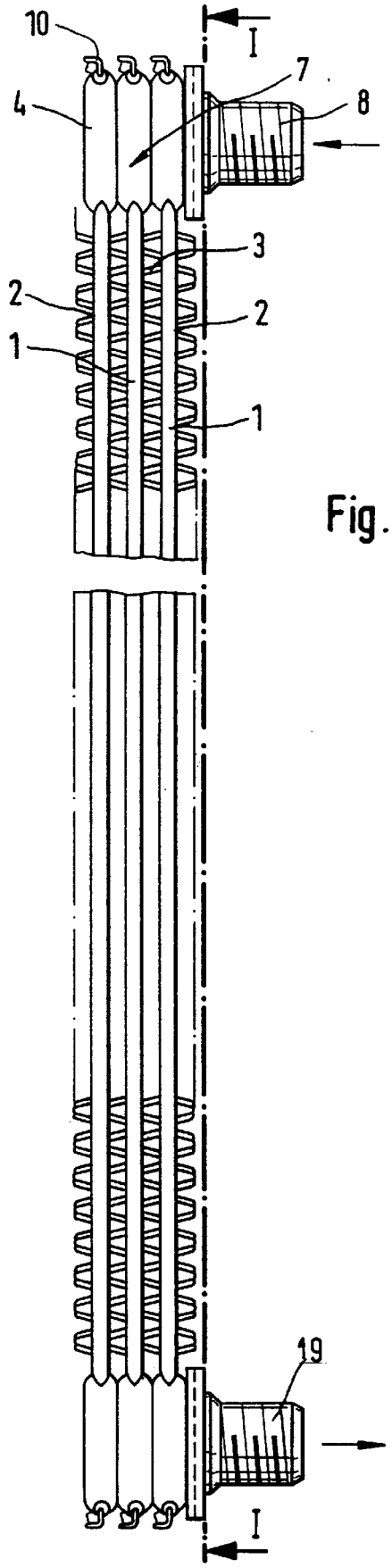
FIG. 2 is a partial front view of the heat exchanger of FIG. 1 viewed in the direction of the arrow II.

FIGS. 1 and 2 show that, for forming a heat exchanger, several flat tubes 1 are provided which are aligned with their larger lateral surfaces 2 in parallel to and at a distance from one another. Corrugated-fin-type inserts 3 in the space between two adjacent flat tubes 1 are arranged which in a known manner contribute to the increase of the heat transfer between a heat exchanger medium flowing through the gaps and the corrugated fins 3 between adjacent flat tubes 1, and a heat exchanger medium flowing through the flat tubes 1.

Figure 3:
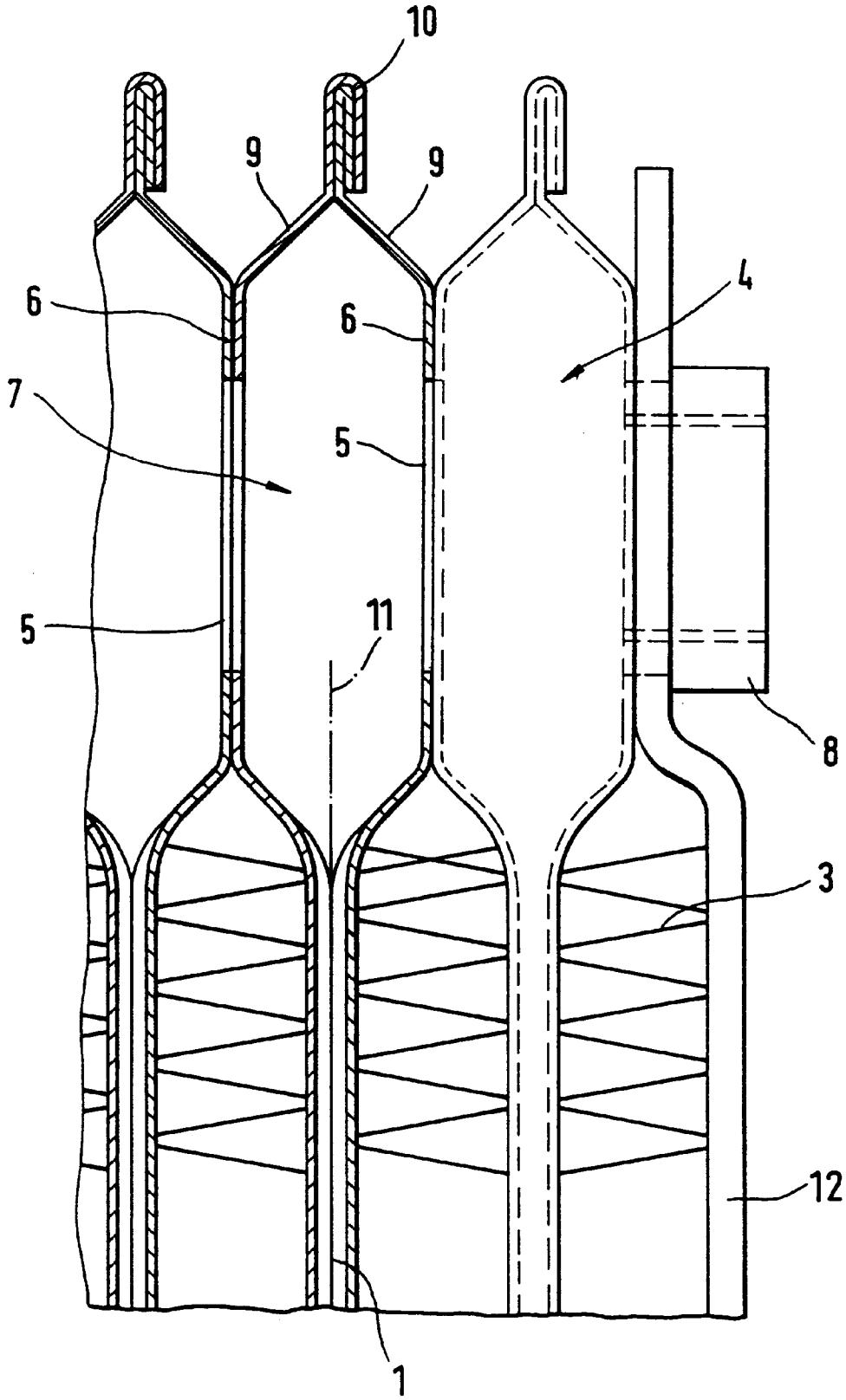
FIG. 3 is an enlarged view of the upper end of a heat exchanger similar to the one shown in FIG. 2.

In order to be arranged in this manner, the flat tubes 1 are each provided at their ends with tank-shaped or box-shaped widenings 4 which were created by a bending-open at first open tube ends of the flat tubes 1. As illustrated particularly also in FIG. 3, these widenings 4 have an approximately tank-shaped construction and are provided with contact surfaces 6 which extend in parallel to one another and of which one is illustrated by latching in FIG. 11 for the purpose of a clarification. In this area of the contact surfaces 6, passage openings 5 are arranged in the lateral walls such that the passage openings 5 of adjacent flat tubes are aligned with one another and therefore form a continuous coolant duct 7, of which only a portion is illustrated in FIGS. 2 and 3. One of the two media participating in the heat transfer can be introduced laterally through a connection piece 8 into this coolant duct 7 and, in a known manner, after flowing through the flat tubes 1, can be guided out of the heat exchanger again through another connection piece 19.

As illustrated, the lateral parts of the widenings 4, which form the contact surfaces 6, are lengthened farther in the upward direction by wall parts 9 which are buckled in from the contact surface 6 toward the inside in each case to the center plane 11 of the flat tube 1 and are then connected with one another by a fold 10. The coolant duct 7 and each section thereof, which is formed by the widening, is therefore tightly closed off to the outside.

In contrast to the representation of FIG. 2, FIG. 3, on the one hand, shows a lateral wall 12 of the heat exchanger and a slightly different form of the connection fold 10.

FIGS. 4 to 11 are referred to for explaining the deformation process of the flat tubes, as provided for producing a heat exchanger according to FIGS. 1 to 3.

Figure 4:
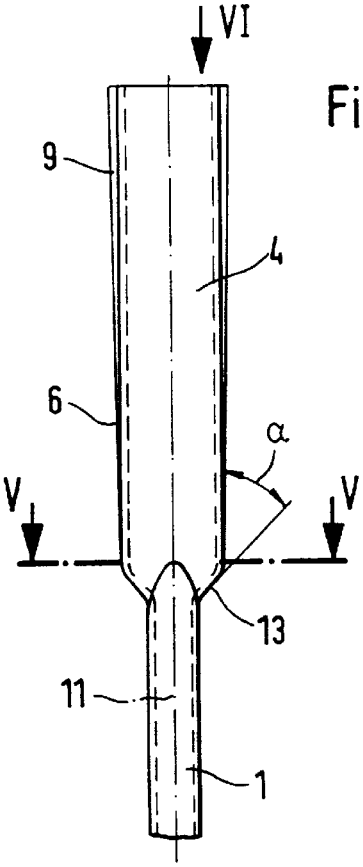
FIG. 4 is a view from the narrow side of an end area of a flat tube to be formed according to the invention.
Figure 5:
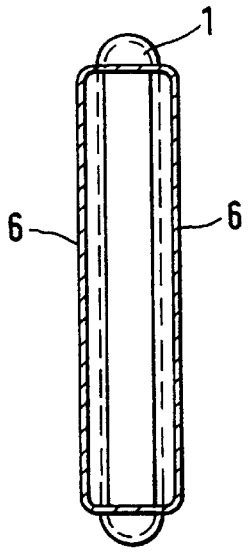
FIG. 5 is a sectional view of the bent-open area of the flat tube of FIG. 4 taken along line V—V.
Figure 6:
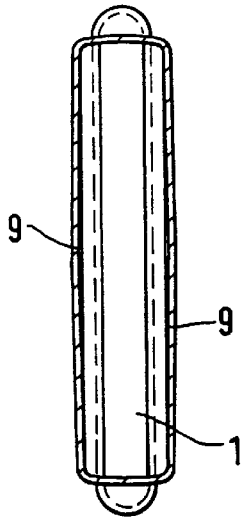
FIG. 6 is a top view of the flat tube of FIG. 4 viewed in the direction of arrow VI.

First the widening 4 of the flat tubes is produced by bending open the flat-tube ends. FIG. 4 shows that the bending-open takes place along a length which corresponds to the length of the contact surfaces 6 measured in the direction of the center plane 11 and of the wall parts 9 used later for forming the fold. FIG. 5 shows the contact surfaces 6 formed by the lateral walls of the flat tubes 1, and FIG. 6 shows the upper end of the wall parts 9.

FIG. 4 also shows that the box-shaped widening 4 changes from the flat-tube cross-section by way of diagonal wall parts 13 into the contact surfaces 6 which are sloped at an angle $\alpha$ with respect to the contact surfaces 6 and to the larger lateral walls of the flat tubes 1. In the illustrated embodiment, this angle is approximately 45°, although it may naturally be varied, for example according to the deformation characteristics of the material, preferably aluminum, used for producing the flat tubes 1.

Figure 7:
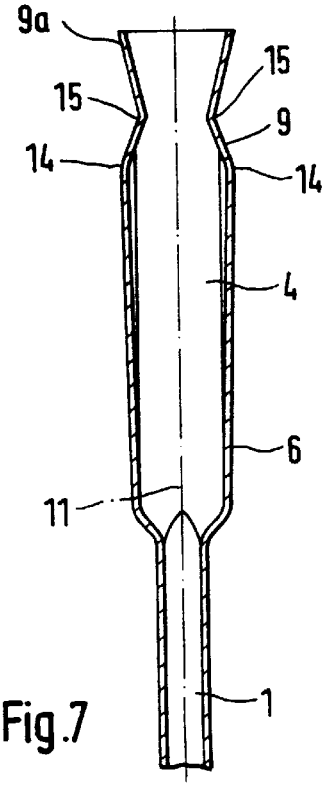
FIG. 7 is a view of the next deforming stage of the bent-open end area illustrated in FIG. 4 for producing an upper closure by means of a fold.

FIG. 7 shows that, in a first process step for producing the closed widening 4, the wall parts 9 are buckled about first buckling edges 14 in each case in parallel to the longitudinal center plane toward the inside by a defined angle and are buckled toward the outside about buckling edges 15 extending again in parallel to the buckling edges 14 so that the ends 9*a* of the wall parts 9 diverge in a wedge shape.

Figure 8:
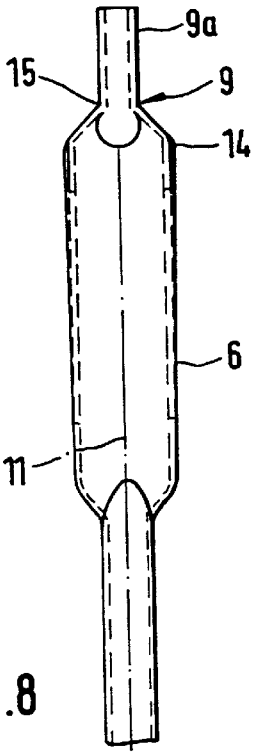
FIGS. 8 to 9 are views of additional deforming stages of the closure area.
Figure 11:
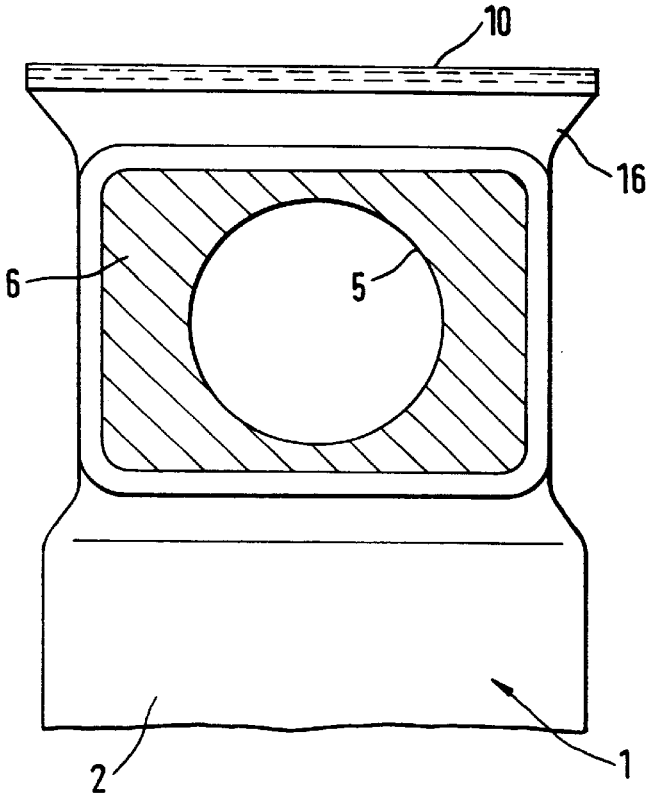
FIG. 11 is a view of the end area of FIG. 10 viewed in the direction of the arrow XI.

These thus formed ends 9*a* are then, according to FIG. 8, each folded onto the joint center plane 11 with respect to one another, in which case the exterior wall parts facing the narrow sides of the flat tubes 1 deform to approximately triangular tabs 16 (see FIG. 11). In the next to the last process step according to FIG. 9, the wall parts 9 are placed flatly against one another so that they touch in the center plane 11 A portion of the wall parts 9 between the buckling edges 14 and 15 will then extend approximately at the same angle $\alpha$ as illustrated in FIG. 4.

Figure 9:
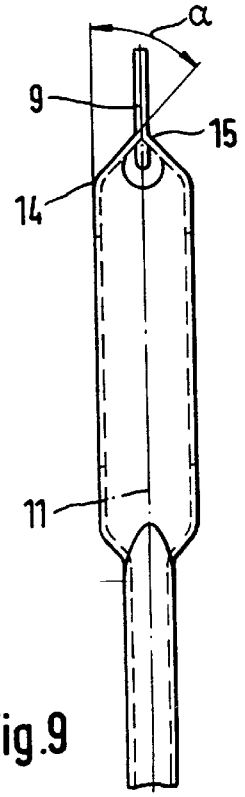
Figure 10:
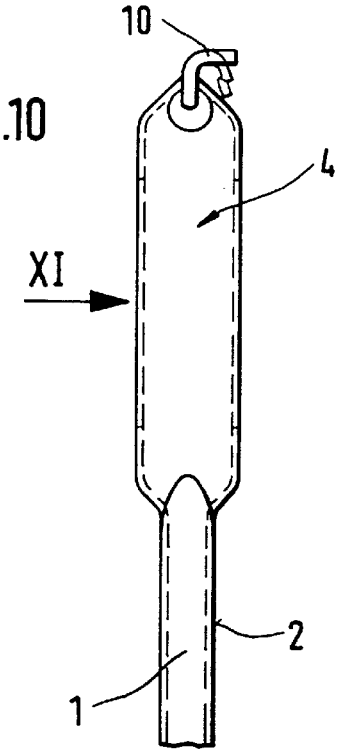
FIG. 10 is a view of the finished end area of the flat tube according to FIGS. 4 to 9.

The wall parts 9, which were placed flatly against one another according to FIG. 9 are then folded over according to FIG. 10 to form the final fold 10 which provides the widening 4 with a tight closure which can therefore form a section of the coolant duct 7.

Figure 12:
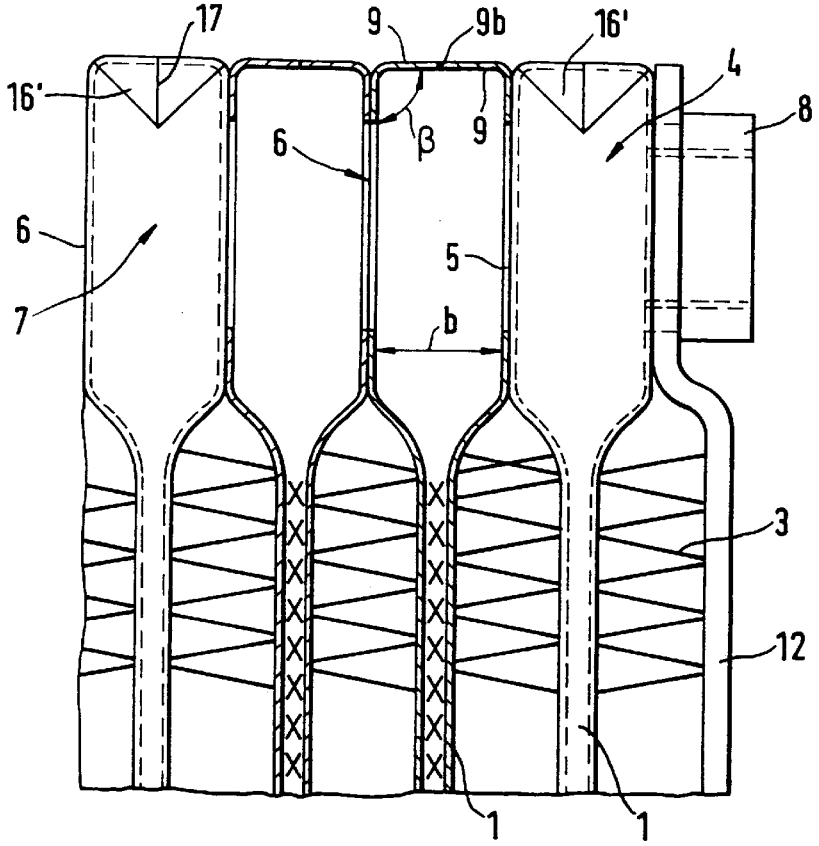
FIG. 12 is a representation similar to FIG. 3 but with a different type of closure of the bent-open area of the tube according to another preferred embodiment.

FIG. 12, in which the same reference numbers are used as in FIG. 3 to refer to the same components, shows that the upper tight closure of the widenings 4 of the flat tubes 1 can also be achieved by providing the wall parts 9 of the bent-open area projecting beyond the contact surfaces 6 only with a length which corresponds to approximately half the width b of the bent-open area 4. The thus designed wall parts 9 are placed in an obtuse manner by means of their end edges 9*b* against one another and are, for example, tightly welded to one another. In the case of such an approach, a buckling-in of the wall parts 9 outside the contact surfaces 6 about an angle $\beta$ of approximately 90° is required. This development may have the advantage that the wall parts 9, which are situated obtusely against one another, of the opposite contact surfaces 6 also provide a spacing, that is, a parallelism, of the contact surfaces 6 if they are dimensioned correspondingly precisely. As in the above-mentioned case, triangular tabs 16' are formed during this bending-over operation on the exterior walls extending transversely to the contact surfaces 6. These tabs 16' can be folded into the exterior surface of the bent-open area 4 and can be mutually connected with one another at their contact point 17 by the same operation which was used for connecting the edges 9*b* of the wall parts 9 which are situated obtusely against one another.

Figure 13:
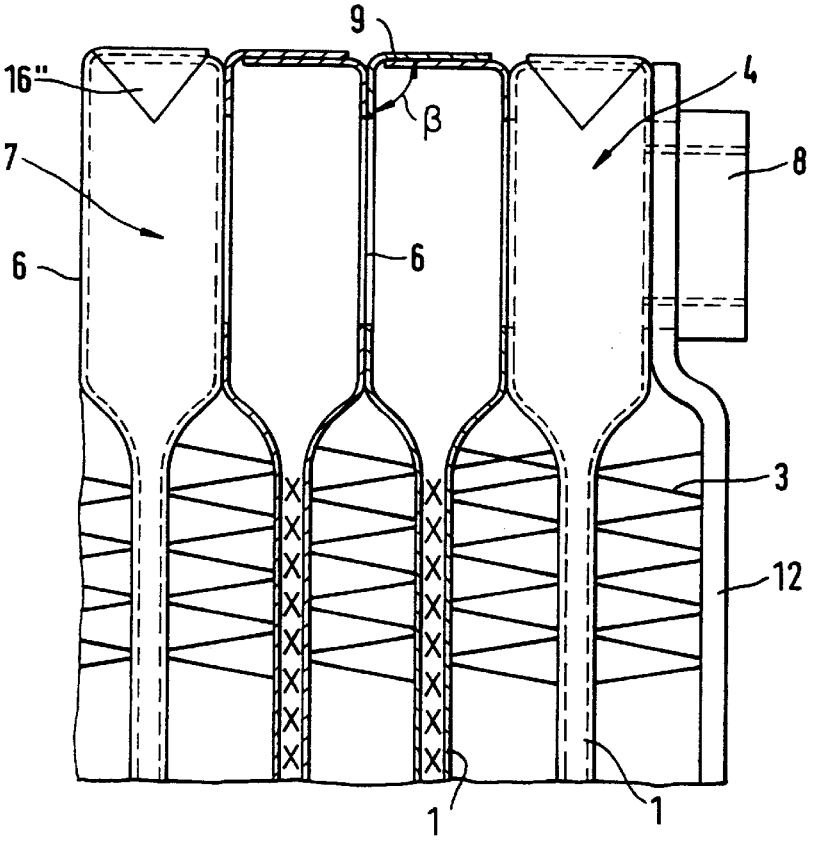
FIG. 13 is a view of another variant of the closure of the bent-open area of the tube according to another preferred embodiment.

FIG. 13 shows another modification in that the wall parts 9 are constructed to be longer than in the case of FIG. 12 and therefore overlap one another after the folding over about the angle $\beta$. Also in this case, triangular tabs 16" are created on the exterior walls extending transversely to the contact areas 6 which, however, similar to FIG. 12, fold over into the surface of the widening 4 and can be fastened there.

The invention therefore makes it possible to eliminate the production and mounting of additional cover parts for closing off the bent-open areas of the tubes.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A heat exchanger comprising a plurality of unitary flat tubes having open end portions which are widened to form sections of a coolant duct, said tubes having contact surfaces defining passage openings, said contact surfaces of adjacent ones of said tubes being placed directly adjacent each other, the open end portions of the flat tubes being connected to form a tight closure, wherein said tight closure is formed by wall parts of the flat tube end portions which extend beyond the contact surfaces and which are folded back to the inside, are placed against one another and are connected with one another.

2. A heat exchanger according to claim 1, wherein each of the wall parts has a length of at least half the width of the sections of the coolant duct.

3. A unitary elongate tube for a heat exchanger having two flat sides arranged essentially mirror-symmetrically on opposite sides of a center plane, said flat sides being connected to each other at a longitudinal end of the elongate tube to close the tube at said longitudinal end, a portion of said elongate tube proximate said longitudinal end being widened such that a contact surface of each of said flat sides is positioned further from said center plane.

4. A unitary elongate tube for a heat exchanger according to claim 3, wherein said contact surface defines an opening to be aligned with a corresponding opening of an adjacent one of said tubes in the heat exchanger.

5. A unitary elongate tube for a heat exchanger according to claim 3, wherein said flat sides are connected to each other at said longitudinal end by an overlapping folded engagement of said flat sides.

6. A unitary elongate tube for a heat exchanger according to claim 3, wherein said flat sides are connected to each other at said longitudinal end by welding.

7. A heat exchanger as defined by claim 2, wherein each of the wall parts has a length sufficient to define an overlapping fold with another of the wall parts.

* * * * *